United States Patent [19]

Canning, Jr.

[11] 4,318,737

[45] Mar. 9, 1982

[54] COPPER REFINING AND NOVEL FLUX THEREFOR

[75] Inventor: Everett J. Canning, Jr., Plainsboro, N.J.

[73] Assignee: Western Electric Co. Incorporated, New York, N.Y.

[21] Appl. No.: 198,516

[22] Filed: Oct. 20, 1980

[51] Int. Cl.[3] ..... C22B 15/00

[52] U.S. Cl. ..... 75/76; 75/93 AD

[58] Field of Search ..... 75/76, 93 AD

[56] References Cited

U.S. PATENT DOCUMENTS

| | | | |
|---|---|---|---|
| 3,561,952 | 2/1971 | Greenberg | 75/76 |
| 3,776,718 | 12/1973 | Leak | 75/63 X |
| 4,058,395 | 11/1977 | Sole | 75/63 X |

FOREIGN PATENT DOCUMENTS

| | | | |
|---|---|---|---|
| 369160 | 4/1973 | U.S.S.R. | 75/76 |

OTHER PUBLICATIONS

Stolarczyk et al. *Journal of the Institute of Metals* vol. 86, pp. 49–58, 1957.

*Primary Examiner*—M. J. Andrews

*Attorney, Agent, or Firm*—Joel F. Spivak

[57] ABSTRACT

A method for removing lead and other basic impurities from copper during refining of the copper comprises treating molten copper to be refined with a slag having a final composition including iron oxide, calculated as $Fe_2O_3$ and silica ($SiO_2$) wherein the weight ratio of iron oxide to silica is from 0.4 to 0.8. The novel slag preferably contains less than 10% boric oxide and up to 30% phosphorus pentoxide.

9 Claims, 2 Drawing Figures

COPPER REFINING AND NOVEL FLUX THEREFOR

TECHNICAL FIELD

This invention relates to the fire refining of copper and novel fluxes to be employed in the fire refining process. More particularly, this invention relates to the removal of lead and other basic impurities from copper by use of a novel flux during fire refining.

BACKGROUND OF THE INVENTION

Fire refining of copper consists of charging blister copper and/or copper scrap into a reverberatory furnace and melting the copper. Typically, silica is added as a flux to assist in forming a slag while the molten copper is oxidized by blowing air below the bath surface. Copper oxide is formed and combines with the silica in the formation of the slag. Impurity elements within the copper are removed by (1) oxidation into the slag, (2) solution into the slag and (3) volatilization to the furnace gases. Oxidation into the slag is the principle method of removing Pb and other impurities from the copper. The slag with the impurities contained therein can then be skimmed from the copper bath thereby leaving a purified copper behind. The removal of impurities from the copper bath can be affected by the chemistry of the particular slag employed. A measure of how a particular slag chemistry affects the removal of an individual elemental impurity is the distribution coefficient (percent impurity in the slag divided by the percent impurity in the copper). The distribution coefficient is a well-defined variable at equilibrium and is a function of the thermodynamic variables including the slag composition, temperature and oxygen level. A large distribution coefficient indicates a high level of impurity removal. In developing fluxes for fire refining, it is desirable to find a chemical additive that has a strong affinity for the impurity element or oxide thereof to be removed from the copper. When the source of copper to be refined is scrap obtained from the electrical cable industry, typical major impurities therein are lead, antimony and tin. These elements have a deleterious effect on certain working properties of copper and on its electrical conductivity and their presence in refined copper is generally undesirable. Lead, for example, is generally present in amounts of less than 10 ppm or even <5 ppm in high grade copper employed for copper cable. A method for removing lead and other materials is by repeated slaging of an oxidized copper bath while air is blown through the melt. It is generally preferred to use a slag composition which has the highest distribution ratio for the impurity to be removed. Various slags employed in attempting to remove lead in the prior art include silica sand; iron oxide ($Fe_2O_3$)-/silica ($SiO_2$) wherein the percentage of iron oxide is generally 25% or less of the initial slag composition; mixtures of iron oxide, silica, and boric oxide wherein the initial weight ratio of silica to iron oxide is approximately 3:1 and containing from 5 to 25% boric oxide; a mixture of iron oxide, silica and phosphorus pentoxide wherein the initial weight ratio of silica to iron oxide is approximately 3:1 and containing from 5 to 25% phosphorus pentoxide; a pure boric oxide flux; a mixture of cuprous oxide and phosphorus pentoxide or cuprous oxide and boric oxide; and a flux consisting of a mixture of cuprous oxide with silica and iron oxide wherein the ratio of silica to iron oxide is 4:1. I have now discovered the existence of an unexpected peak in the distribution coefficient for the removal of lead impurities from copper when using the iron oxide-silica system. This peak occurs at a iron/silica ratio heretofor not employed in the prior art. I have further discovered that the distribution coefficient can be enhanced by the addition of certain other additives to the flux while operating in the same iron oxide/silica ratio range.

SUMMARY OF THE INVENTION

A method for removing lead and other basic impurities from copper during refining of the copper comprises treating molten copper to be refined with a slag having a final composition including iron oxide, calculated as $Fe_2O_3$ and silica ($SiO_2$) wherein the weight ratio of iron oxide to silica is from 0.4 to 0.8. The novel slag preferably contains less than 10% boric oxide and up to 30% phosphorous pentoxide.

DETAILED DESCRIPTION OF THE INVENTION

I have unexpectedly discovered that the distribution coefficient of lead between an iron oxide-silica based slag exhibits a peak in the area of about 0.5 weight fraction iron oxide to silica. I have also discovered that this peak is enhanced in that the lead distribution coefficient increases when phosphorus pentoxide is added to the flux. It may be noted that it is preferable that the slag be free of boron oxide or at least contain less than 10% boric oxide due to the corrosiveness of the boric oxide on the furnace.

The term, lead distribution coefficient, ($D_{Pb}$) is the ratio of the lead concentration in the slag to the lead concentration remaining in the copper after refining. Generally, these distribution ratios are obtained under equilibrium conditions between the slag and the molten copper. The higher the lead distribution coefficient the more efficient the extraction of lead impurity from the copper. I have found that the critical ratio in order to obtain the maximum distribution coefficient the weight ratio of iron oxide, calculated as $Fe_2O_3$ to silica, $SiO_2$. As will hereinafter become apparent, preferred ratios are from about 0.42 to 0.64 for the attainment of maximum distribution coefficients for lead removal.

The typical method for purification of copper in fire refining is to melt the copper, holding the bath at a temperature of about 1120° to 1150° C., then adding the desired flux to the copper and bubbling oxygen through the molten copper bath. After a desired length of time, the slag which forms on top of the copper may then be skimmed from the copper melt. In determining the most preferred bath conditions in addition to that of the distribution coefficient for removal of the given impurity, one must be cognizant of the time it takes to achieve removal of the impurity from the copper into the slag, the corrosiveness of the slag to the furnace, and the cost of raw materials. All of these factors may be termed economic factors. Another economic factor is the amount of copper which enters the slag as copper oxide. This represents a loss of copper although this copper may be recovered at a later step.

Figure 1:
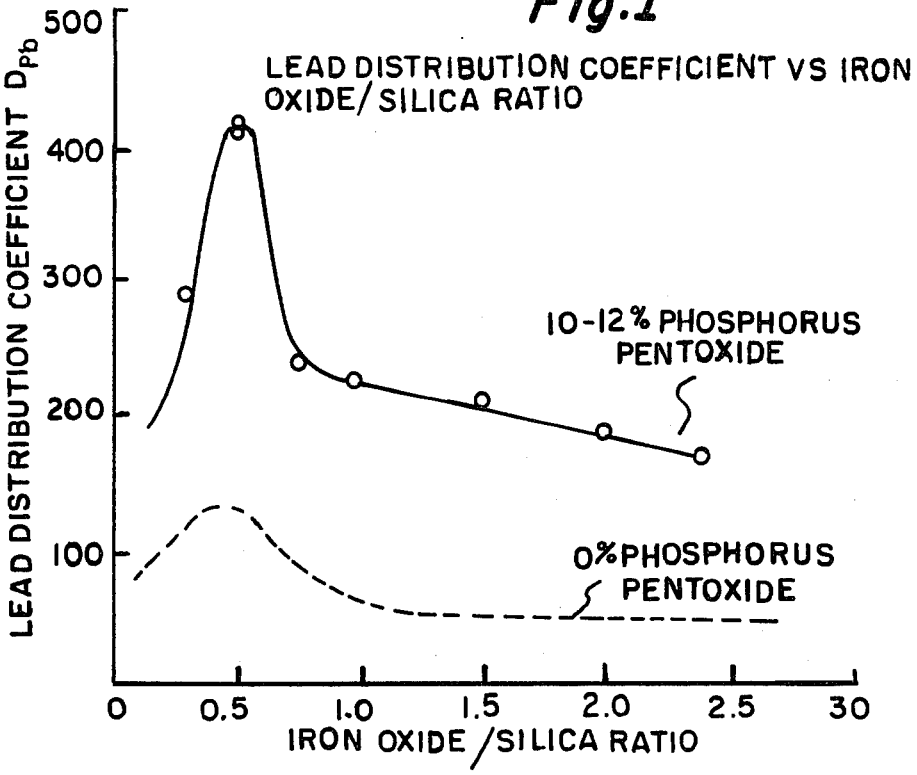
FIG. 1 is a plot showing the lead distribution coefficient as a function of a weight ratio of iron oxide to silica in the slag used to extract lead impurities from the molten copper.

Referring to FIG. 1, there is shown two curves obtained from the results of several experiments. These curves are plots of the lead distribution coefficient as a function of the iron oxide/silica ratio. As can be seen from these plots, there occurs a peak in the lead distribution coefficient in an iron oxide/silica ratio range of from about 0.4 to 0.8 independent of the amount of phosphorus pentoxide added to the slag. Additionally it can readily be seen that the curve obtained with from 10–12 weight percent phosphorus pentoxide in the slag gives a much higher lead distribution coefficient than the phosphorus free slag while showing the same or essentially the same peak in lead distribution coefficient at an iron oxide to silica ratio of about 0.5. Since the phosphorus is relatively expensive and is somewhat corrosive, phosphorus contents in the slag of from 4–10 weight percent as $P_2O_5$ are preferred but phosphorus levels of up to 30% or more may be used. The percent of oxygen in the copper melt after refining was determined as between 0.2 to 1.0 and generally between 0.4 to 0.7. I have found that there is a slight effect on the distribution coefficient based upon the oxygen level and that $D_{Pb}$ is maximized at an oxygen level of between 0.6 to 0.8. However, since the effect is small, the actual preferred oxygen range may be somewhat different for reasons hereinafter set forth.

Figure 2:
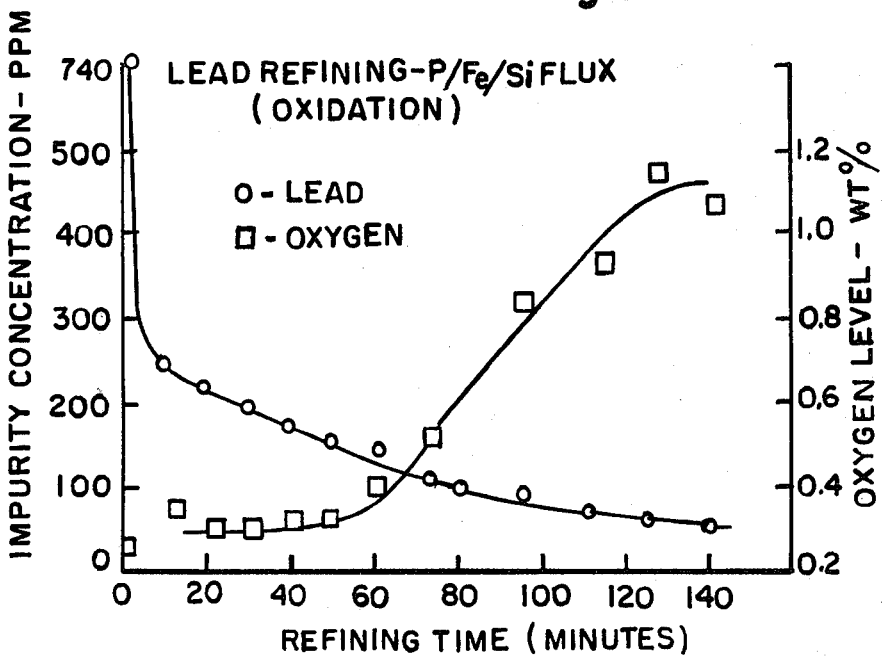
FIG. 2 is a graph showing the lead impurity concentration remaining in the copper and the oxygen level of the slag as a function of refining time.

FIG. 2 is a plot showing the impurity concentration remaining in the copper as a function of refining time employing a phosphorus pentoxide/iron oxide/silica flux wherein the iron oxide to silica ratio is 0.45 and the phosphorus pentoxide content is 7 weight percent in the slag. It should be noted that the amount of copper entering the slag in a form of $Cu_2O$ depends upon the oxygen content of the copper and slag. When the copper becomes saturated with oxygen, that is at a weight percent oxygen of approximately 1.1 weight percent, the slag can contain as much as 67 weight percent cuprous oxide. The weight percent cuprous oxide in the slag from the results shown in FIG. 1 is approximately in the range of about 55 weight percent. FIG. 2, in addition to showing the impurity concentration remaining in the copper with refining time, also shows the oxygen level of the copper with refining time. As can be seen from FIG. 2, during the first 10-minute interval, there is a rapid extraction of lead from the copper by the flux. Thereafter, the rate of extraction of lead from the copper decreases fairly uniformly and apparently decreases to a still lesser rate after approximately 1 hour and 20 minutes. On the other hand, the oxygen level of the copper increases fairly rapidly after about 50 minutes of continuously blowing oxygen through the melt and levels off (saturates) after approximately 2 hours. Since, as the oxygen level increases the amount of copper entering the slag also increases, it is desirable to limit the refining time such that reasonable extraction stills occurs with minimal loss of copper to the slag. Therefore, a preferred oxygen level for this purpose is between 0.4 and 0.6 weight percent. As a compromise, in order to also maintain a high distribution coefficient, oxygen levels of from 0.5–0.7 are suitable. In any event, the preferred oxygen levels will lie between 0.4 to 0.8% oxygen in the copper bath. It may be noted that the novel method for lead extraction is fairly rapid as well as efficient as compared to prior methods.

What is claimed is:

1. A method for refining copper comprises treating an oxygenated molten copper bath with a flux which forms a skimmable slag comprising iron oxide and silica in a weight ratio of from 0.4 to 0.8.

2. The method recited in claim 1 wherein the slag contains less than 10% boric oxide.

3. The method recited in claims 1 or 2 wherein the slag contains phosphorus in an amount up to about 30 weight percent measured as $P_2O_5$.

4. The method recited in claim 1 including phosphorus in the slag.

5. The method recited in claims 1 or 4 wherein the iron oxide/silica ratio is from 0.42 to 0.64.

6. The method recited in claims 1 or 4 wherein the iron oxide/silica ratio is about 0.5.

7. The method recited in claim 1 wherein the oxygen level of the copper bath is from 0.4 to 0.8 weight percent oxygen.

8. The method recited in claim 1 wherein the oxygen level of the copper bath is from 0.5 to 0.7 weight percent oxygen.

9. The method recited in claim 1 wherein the oxygen level of the copper bath is from 0.4 to 0.8 weight percent, the iron oxide/silica ratio of the slag is from 0.42 to 0.64 and slag contains phosphorus in an amount up to 30 weight percent as $P_2O_5$.

* * * * *